US007464729B2

(12) United States Patent
Vanderjeugt et al.

(10) Patent No.: US 7,464,729 B2
(45) Date of Patent: Dec. 16, 2008

(54) JACQUARD MACHINE

(75) Inventors: Bram Vanderjeugt, Ypres (BE); Matthew Theobald, Consett (GB); James Anthony Graham, Weardale (GB)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 272 days.

(21) Appl. No.: 11/384,025

(22) Filed: Mar. 17, 2006

(65) Prior Publication Data

US 2006/0207675 A1 Sep. 21, 2006

(30) Foreign Application Priority Data

Mar. 21, 2005 (BE) ..... 2005/0150

(51) Int. Cl.

| | |
|---|---|
| ***D03C 3/36*** | (2006.01) |
| ***D03C 5/02*** | (2006.01) |
| *D03C 13/00* | (2006.01) |
| *D03C 3/00* | (2006.01) |

(52) U.S. Cl. ..... 139/55.1; 139/65; 139/81; 139/86

(58) Field of Classification Search ..... 139/55.1, 139/57–65, 79–81, 85, 86

See application file for complete search history.

(56) References Cited

U.S. PATENT DOCUMENTS

| | | | | |
|---|---|---|---|---|
| 2,559,507 | A * | 7/1951 | McKnight | 139/82 |
| 2,980,145 | A * | 4/1961 | Herard, Jr. et al. | 139/80 |
| 3,759,298 | A * | 9/1973 | Kaufmann | 139/82 |
| 4,936,352 | A * | 6/1990 | Keim | 139/65 |
| 5,103,873 | A * | 4/1992 | Bassi | 139/59 |
| 5,115,838 | A * | 5/1992 | Derudder | 139/65 |
| 5,176,181 | A * | 1/1993 | Bassi | 135/55.1 |
| 5,183,080 | A * | 2/1993 | Bassi et al. | 139/55.1 |
| 5,513,676 | A * | 5/1996 | Speich | 139/65 |
| 5,653,268 | A * | 8/1997 | Burkert | 139/79 |
| 5,671,781 | A * | 9/1997 | Palau | 139/59 |
| 5,678,612 | A * | 10/1997 | Derudder et al. | 139/65 |
| 5,794,665 | A * | 8/1998 | Keim | 139/455 |
| 5,927,347 | A * | 7/1999 | Palau et al. | 139/65 |
| 6,463,962 | B2 * | 10/2002 | Dewispelaere | 139/65 |
| 7,017,619 | B2 * | 3/2006 | Bassi | 139/59 |
| 2004/0221911 | A1 * | 11/2004 | Bassi | 139/111 |
| 2006/0249219 | A1 * | 11/2006 | Vanderjeugt et al. | 139/87 |

FOREIGN PATENT DOCUMENTS

| | | |
|---|---|---|
| EP | 0754791 | 1/1997 |
| FR | 2802219 | 6/2001 |

* cited by examiner

*Primary Examiner*—Bobby H Muromoto, Jr.
(74) *Attorney, Agent, or Firm*—James Creighton Wray; Clifford D. Hyra

(57) ABSTRACT

A Jacquard machine, having at least two knife grids (5, 6)moving up and down in opposition on either side of the Jacquard machine, the Jacquard machine having a single-sided drive (1) for driving at least one driving lever (2,3) which is provided for driving the motion of the knife grids (5, 6) on either side of the Jacquard machine, and one traversing rocking shaft (24) being provided to transmit the motion of the driving lever (2 and 3 respectively) to the knife grids (5,6) of one of the sides of the Jacquard machine.

27 Claims, 7 Drawing Sheets

JACQUARD MACHINE

This application claims the benefit of Belgian Application No. 2005/0150 filed Mar. 21, 2005, which is hereby incorporated by reference in its entirety.

BACKGROUND OF THE INVENTION

The invention relates to a Jacquard machine, comprising on either side of the Jacquard machine at least two knife grids moving up and down in opposition.

The necessity to produce Jacquard machines operating at higher speeds at lower prices and, at the same time, sufficiently strong to be capable of forming the shed to suit the requirements in an accurate and reliable manner in order to realize a fabric of the quality desired, is putting an ever growing pressure on the construction of Jacquard machines. It is therefore important for the construction of Jacquard machines to make the knife drive, driving two sets of knives moving up and down in opposition, sufficiently rigid at a minimal cost. The two sets of knives moving up and down in opposition are taken up in a knife grid on either side of the Jacquard machine, such that both on the left and right side of the Jacquard machine (seen from the position of the weaver looking in the direction where the warp yarns are supplied) two knife grids are moving up and down in opposition.

In the cost price of a Jacquard machine, the costs for gearboxes to drive the motion of these knife grids as well as the components extending across the width of the Jacquard machine (from left to right) are of great consequence. Furthermore, the components, for instance, rocking levers, will not only become cheaper when it is possible to make them of more compact design, but the forces due to inertia will become less during their rocking motion, which is particularly favourable when realizing higher operational speeds with the Jacquard machine.

In EP 136 244 a solution is described where either side of the Jacquard machine is provided with a drive by means of an ordinary crank mechanism, each having a connecting rod driving two rocking levers, together driving the movable grids on one side of the Jacquard machine. The device is provided with a continuously rotating traversing shaft, linking up two ordinary crank mechanisms. The said rocking levers linked up are interconnected such that they are moving symmetrically and in opposition in order to minimize the forces on the straight guide way for realizing an almost vertical motion of the knife grids. This solution has the disadvantage that an expensive two-sided drive has to be provided. This disadvantage is still of more consequence in case the ordinary crank mechanism should be replaced by a gearbox with cams. Moreover the continuously rotating traversing shaft is situated below the knife grids, which is a disadvantage with respect to the accessibility of the Jacquard machine at the level of the selection system of the pulley system.

In EP 109 139 the problem of the accessibility is solved by installing the continuously rotating drive shaft, interlinking the two gearboxes, above the knife grids, crosswise in the centre of the Jacquard machine, each gearbox being provided with a set complementary cams, driving two cam followers situated diametrically opposed to each other. Each cam follower is linked up to or is part of a rocking lever, from which each of its extremities are linked with a different knife grid. Thus the accessibility of the selection systems and the pulley systems indeed having been improved, but two gearboxes are still required and the installation of the gearboxes, crosswise in the centre, will give cause to the need of big, expensive, heavy and heavily loaded rocking levers which extend along almost the total depth (crosswise distance) of the Jacquard machine. This will also strongly increase the inertia of the system.

In EP 754 791 a device is described with only one gearbox on one side, crosswise in the centre of the Jacquard machine, because of which a continuously rotating traversing shaft has become superfluous. The gearbox with its conjugated cams is driving two cam followers each of which is linked with a traversing rocking shaft, two levers being provided on each of the traversing rocking shafts, each of them driving one extremity of the knife grids on either side of the Jacquard machine. Moreover the two rocking shafts are of a coaxial design. This embodiment is offering a solution to limit the drives to only one gearbox, but it is still provided with two traversing rocking shafts, which in itself is already an expensive solution and which moreover, additionally is made still heavier because of the coaxial design of both shafts. Moreover, the levers, linked with these coaxial shafts are still extending almost along the total depth of the Jacquard machine, rendering the solution still more expensive and which has an increasing effect on the inertia.

In EP 1 475 465 a Jacquard machine is described, which on either side, is driven by an eccentric-connecting rod mechanism, the drive occurring crosswise in the centre of the Jacquard machine and both sides are linked by a continuously rotating shaft. Each eccentric-connecting rod mechanism is driving a traversing rocking shaft equipped with two rocking levers, one on either side of the Jacquard machine. The two rocking shafts are rocking in opposition and the rocking levers are extending almost along the entire depth of the Jacquard machine. With three traversing shafts, i.e. one continuously rotating shaft and 2 rocking shafts, this is not only an expensive solution, but also the accessibility is strongly restricted. Also the design of the large and heavy rocking levers still remains an expensive solution which has an inertia increasing effect.

SUMMARY OF THE INVENTION

The purpose of the invention is to provide a Jacquard machine having a rigid construction and which may be used at high speeds whereas it will be possible to keep the price of the construction within limits.

This purpose of the invention is attained by providing a Jacquard machine in accordance with the heading of the first claim, the Jacquard machine comprising a single-sided drive for driving at least one driving lever which is provided to realize the motion of the knife grids on either side of the Jacquard machine and one traversing rocking shaft being provided for transmitting the motion of the said driving lever to the knife grids on one side of the Jacquard machine.

By providing such a Jacquard machine, the Jacquard machine will have a rigid construction and may be used at high speeds and moreover, the cost of the construction remains within bounds.

In a first preferred embodiment of a Jacquard machine according to the invention, one driving lever is provided, driving the traversing rocking shaft, a first rocking lever being attached on either side of the shaft, which is provided with at least a first and a second lever arm, each being linked with one extremity of one of the two knife grids of a set.

In a second preferred embodiment of a Jacquard machine according to the invention, the Jacquard machine is provided with two driving levers, i.e.

- a first driving lever for driving the motion of the knife grids on one side of the Jacquard machine;
- a second driving lever for driving the motion of the knife grids on the other side of the Jacquard machine;

and the traversing rocking shaft being provided to transmit the motion of one of the said driving levers to the knife grids on the side opposite to the side of the single-sided drive.

Preferably, each driving lever is provided with a first rocking lever, comprising at least a first and a second lever arm, each of which is provided to be linked with one extremity of one of the two knife grids of a set on the respective side of the Jacquard machine.

In order to ensure that the said extremities of both knife grids each will perform an opposite motion going up and down, preferably each driving lever is linked with at least one second rocking lever and the first rocking lever is provided of at least one third lever arm which is linked with a third lever arm of the second rocking lever, and a first and a second rocking lever arm of the said second rocking levers each being linked with the other extremity of one of the two knife grids.

In a preferred embodiment of a Jacquard machine according to the invention, the said first and second lever arms are installed such that the linking point on the first lever arm is performing a motion in opposition to the motion being performed by the linking point on the second lever arm.

In a first possible embodiment of a Jacquard machine according to the invention, the third lever for both rocking levers is situated on the same side of the linking surface between the axes of rotation of these rocking levers. This offers the advantage that it will be possible to use identical rocking levers.

In another possible embodiment of a Jacquard machine according to the invention, the third lever arm of both rocking levers is situated on a different side of the linking surface between the axes of rotation of these rocking levers. This has the advantage that each motion of a rocking lever is dynamically compensated by the motion in the opposite direction of the other rocking lever.

In an advantageous embodiment of a Jacquard machine according to the invention, at least one first rocking lever is linked with two single second rocking levers rotating about a same axis and each of which has at least two linking points, in a first linking point a link being constituted with the first rocking lever and in a second linking point a link being constituted with the extremity of a knife grid.

The linking points which are linking the connecting rods constituting the link between the two single second rocking levers and the first rocking lever with the third lever arms of the first rocking lever, are preferably situated on both sides of the linking surface, constituted by the axis of rotation of the first rocking lever and the axis of rotation of the two single second rocking levers, in order to make both second rocking levers to perform a motion in opposition, such that their second linking point with the extremity of the knife grids will perform a motion in opposition.

In another advantageous embodiment of a Jacquard machine according to the invention, at least one of the driving levers is linked with an intermediate lever with two lever arms, each of which in a linking point is linked with a connecting rod, one connecting rod is constituting the link between the intermediate lever and a first rocking lever, whereas the second connecting rod is constituting the link between the intermediate lever and a second rocking lever, and both rocking levers being provided with a first lever arm and a second lever arm, each being linked with an extremity of a knife grid on one side of the Jacquard machine in order to drive it.

In a preferred embodiment of a Jacquard machine according to the invention, the mutual link between the lever arms and/or the linking between the lever arms and the extremities of the knife grids occurs by means of linking rods.

A preferred embodiment of a Jacquard machine according to the invention is provided with a continuously rotating input shaft, the rotational motion of this shaft being converted into a rocking motion.

In a first advantageous embodiment of a Jacquard machine according to the invention, the drive is a gearbox with a cam shaft and complementary cams, the driving levers being designed in the form of cam follower levers.

Preferably, the cam shaft may be provided with one set of complementary cams.

In a preferred embodiment of a Jacquard machine according to the invention, the first cam follower lever is provided below the cam shaft and the second cam follower lever is provided above the cam shaft, such that both are situated diametrically with respect to one another.

Preferably, in this case, the first cam follower lever is linked with the corresponding first rocking lever by means of a short shaft.

In a preferred embodiment of a Jacquard machine according to the invention, the second cam follower lever is linked with the corresponding first rocking lever by means of a traversing rocking shaft.

In an advantageous embodiment of a Jacquard machine according to the invention, the two first rocking levers are rocking coaxially.

On the one hand, the first cam follower lever may preferably on its short shaft be provided with a lever with one or two lever arms, each of which in a linking point, by means of a linking rod, is linked with the lever arms of the corresponding first rocking lever, which on its drive is coaxially mounted on bearings which are mounted on their turn on the traversing rocking shaft, which is linking the second cam following lever with its corresponding first rocking lever.

Secondly, the second cam follower lever may be linked with a short shaft which is provided with a lever with one or two lever arms, each of which in a linking point, by means of a linking rod, is linked with a lever with one or two lever arms on the traversing rocking shaft, which is situated coaxially with the short shaft, linking the first cam follower lever to the corresponding first rocking lever.

Thirdly the second cam follower lever may be linked with the traversing rocking shaft, which at its extremity on the side away from the drive is provided with a lever with one or two lever arms, each of which in a linking point, by means of a linking rod, is linked with a lever arm of the first rocking lever for driving the knife grids on the side away from the drive, the said first rocking lever being rocking about a short shaft coaxially situated with respect to the short shaft linking the first cam follower lever with its corresponding first rocking lever.

Fourthly, the first cam follower lever may be linked with a short shaft and the second cam follower lever may be linked with the traversing rocking shaft, both cam follower levers on the corresponding shaft being linked with a lever with a lever arm which in a linking is linked with a connecting rod constituting the link with the corresponding first rocking lever, these first rocking levers, through their respective third lever arm, each being linked with a linking rod, constituting the link with the respective one or several second rocking levers, the two first rocking levers being installed coaxially.

Fifthly, the first cam follower lever may be provided on the corresponding short shaft of a first intermediate lever, and the second cam follower lever on the traversing rocking shaft may be provided with a second intermediate lever, the intermediate levers being provided with two lever arms, each of which in a linking point are linked with a connecting rod, one connecting rod constituting the link between the intermediate lever and a first rocking lever, whereas the second connecting rod is constituting the link between the intermediate lever and a second rocking lever, both rocking levers being provided with a first lever arm and a second lever arm, each of which is linked with an extremity of a knife grid of one side of the Jacquard machine in order to drive it, and the two first rocking levers being installed coaxially.

On the other hand, the cam shaft may be preferably provided with two sets of two complementary cams, such that the first and the second cam follower levers are installed next to one another and are moving in opposition, the first cam follower lever and the respective first rocking lever coaxially rocking about the traversing rocking shaft between the second cam follower lever and its respective first rocking lever.

In a second advantageous embodiment of a Jacquard machine according to the invention, the drive is a crank mechanism or an eccentrically driven connecting rod.

Preferably, the drive comprises a drive shaft with two eccentrics, each eccentric driving a connecting rod, one connecting rod imposing a rocking motion on a short shaft and the other connecting rod imposing a rocking motion on the traversing rocking shaft.

In order to further clarify the characteristics of this invention and to point out additional advantages and particulars, now a more detailed description will follow of various embodiments of a drive of a Jacquard machine according to the invention. It may be obvious that nothing of the following description may be interpreted as being a restriction of the protection of the method and the device according to the invention, demanded for in the claims.

Furthermore, some of these embodiments are discussed in the attached figures, referring, by means of reference numbers to these figures, in which:

DETAILED DESCRIPTION OF THE PREFERRED EMBODIMENTS

Figure 2:
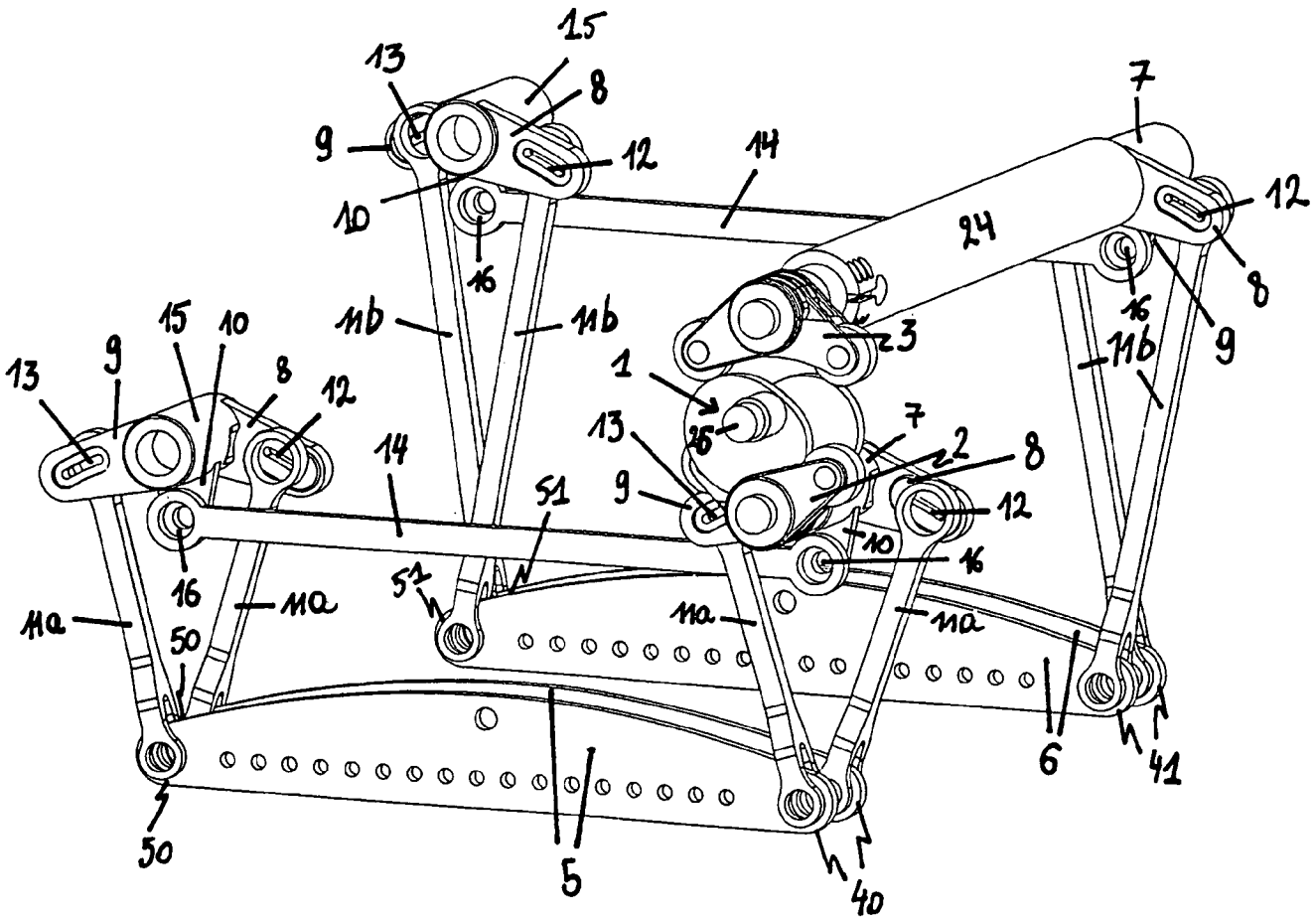
FIG. 2 is representing the embodiment of FIG. 1, in which several knife grids are driven.
Figure 3:
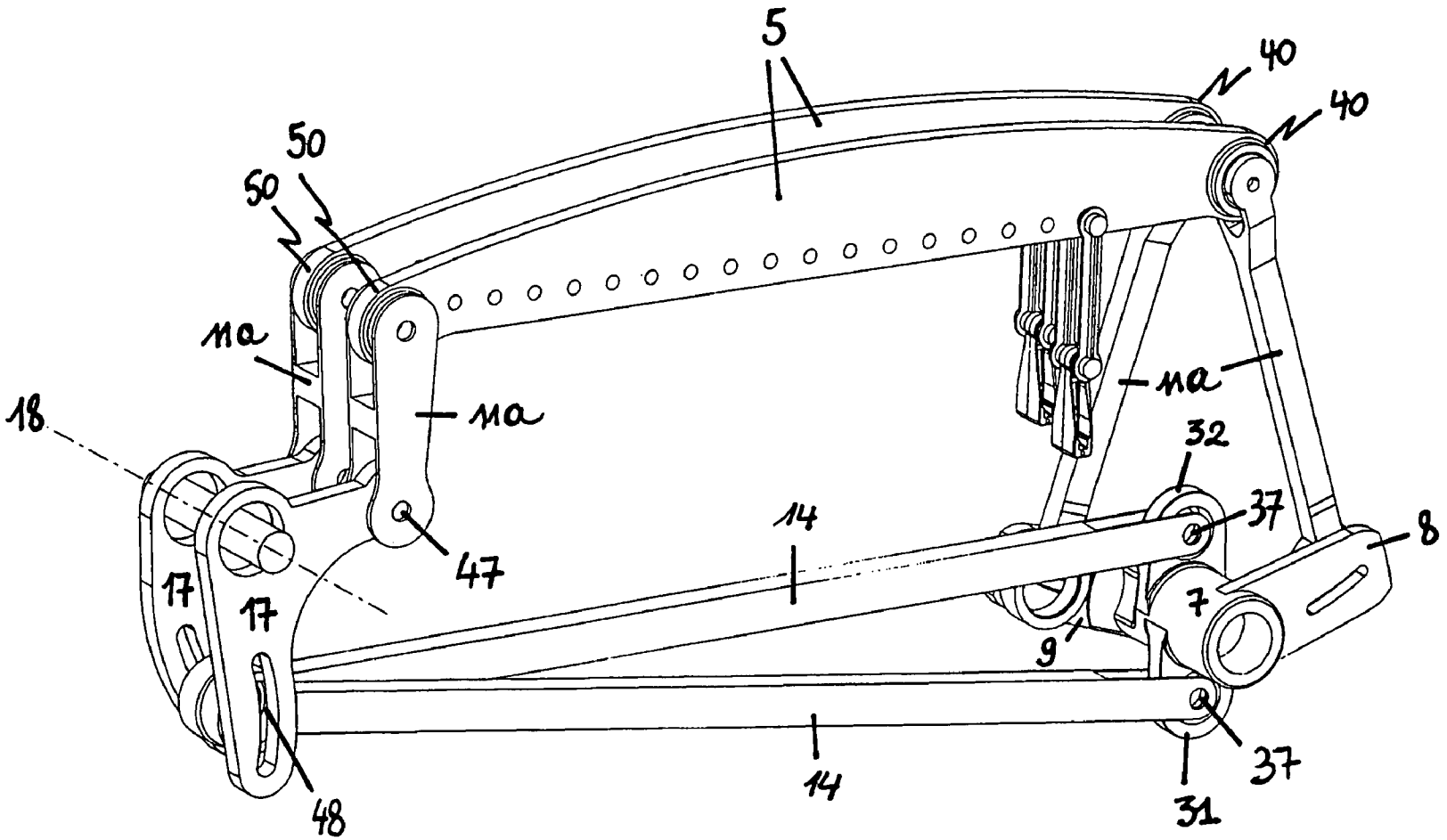
FIG. 3 is representing a second embodiment for one side of the Jacquard machine of a drive of the knife grids of a Jacquard machine according to the invention, two rocking levers being provided per side.
Figure 7:
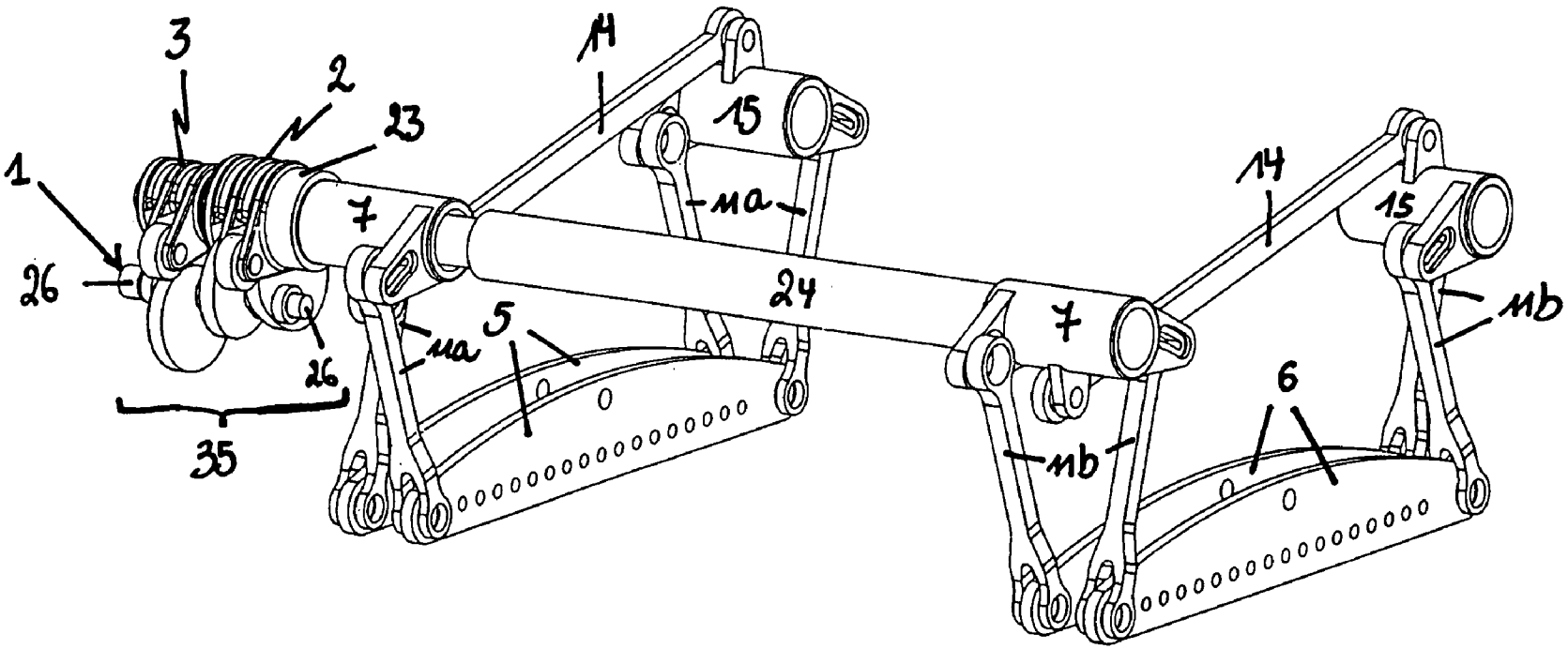

A Jacquard machine according to the invention, comprises at least 2 sets of knife grids (5, 6) moving up and down in opposition on either side of it (see FIGS. 2, 3, 7 up to and including 10). For driving the motion of the knife grids (5, 6) on either side of the Jacquard machine, at least one driving lever (2, 3, 10) is provided being driven by a single-sided drive (1) situated either on the left side or on the right side of the Jacquard machine and which may be installed crosswise in the front, at the back or in the middle (seen from the position of the weaver looking in the direction from where the warp yarns are supplied). With a single-sided drive (1) it is possible to reduce the cost substantially, since the costs of an expensive doubled-sided drive according to the state-of-the-art are no longer to be paid. The double-sided drive being no longer required, the traversing continuously rotating shaft, as described according to the state-of-the-art, is no longer needed, however, the rocking motion of the drive side has to be transmitted to the side where no drive is available. For that purpose, a traversing rocking shaft (24) is provided to transmit the motion of the said driving lever (2, 3, 30) to the knife grids (6) on the side of the Jacquard machine away from the drive (1).

Figure 1:
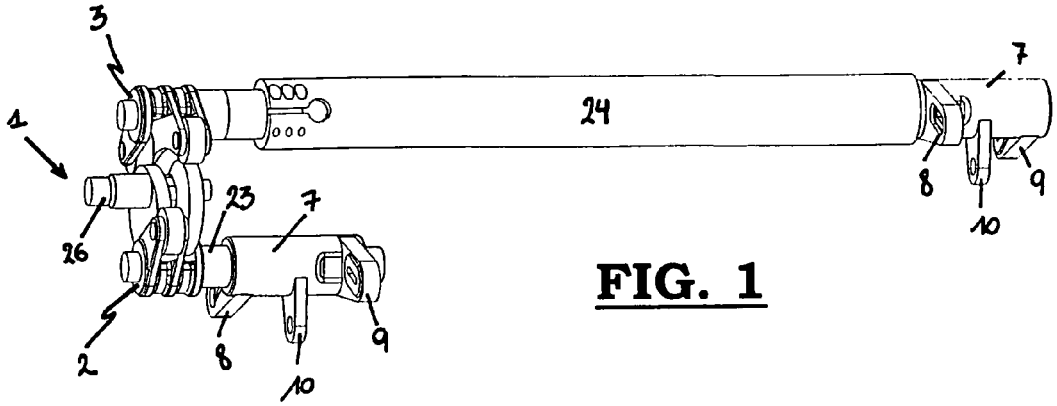
FIG. 1 is representing a first embodiment of a drive of a Jacquard machine according to the invention.
Figure 4:
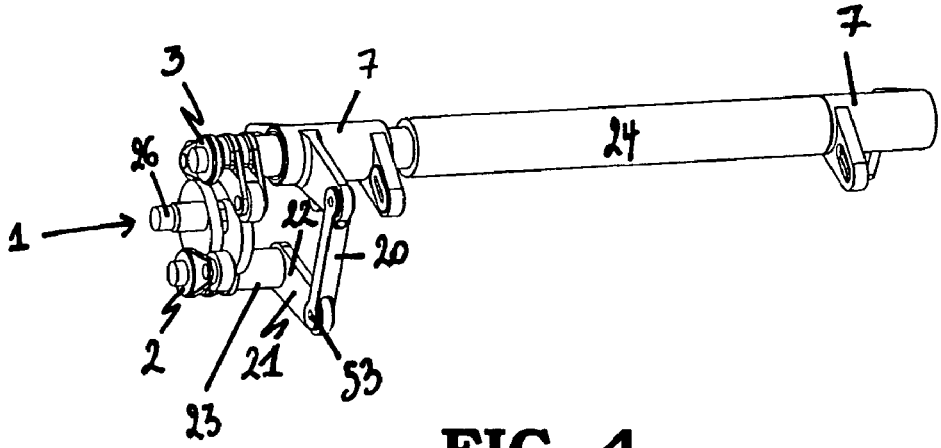
FIGS. 4 up to and including 9 are representing other embodiments of a drive of a Jacquard machine according to the invention, in which the first rocking levers are coaxial.

As represented in the FIGS. 1, 2, 4 up to and including 7 and 9, on the one hand, the drive may be provided for driving a first and a second driving lever (2, 3), the first driving lever (2) being provided for driving the motion of the knife grids (5) on one side of the Jacquard machine, whereas the second driving lever (3) is provided for driving the knife grids (6) on the other side of the Jacquard machine. The traversing rocking shaft (24) being provided for transmitting the motion of the first or second driving lever (2, 3) to the knife grids (5, 6) on the side opposite the single-sided drive (1).

Each driving lever (2, 3, 30) may be provided with a first rocking lever (7), which is provided with at least a first and a second lever arm (8, 9), each of these lever arms (8, 9) being provided to be linked with one extremity (40, 41) of one of the two knife grids (5, 6) of a set on the corresponding side of the Jacquard machine. The said two lever arms (8, 9) are installed such that the linking point (12) on one lever arm (8) is performing a motion opposite to the motion, the linking point (13) on the other lever arm (9) is performing, because of which the said one extremities (40, 41) of both knife grids (5, 6) are each performing a motion going up and down in opposition.

In order to drive the other extremity (50, 51) of the knife grids (5, 6) in order to perform a motion going up and down in opposition:

each driving lever (2, 3, 30) may be linked with at least a second rocking lever (15) and the first rocking lever (7) may be provided with a third lever arm (10) which is linked with at least one third lever (10) arm provided on the second rocking lever (15) by means of linking points (16), a first and a second lever arm (8, 9) of the said second rocking lever (15) each being linked with the other extremity (50), of one of both knife grids (5, 6). The first lever arm (8) and the second lever arm (9) of this second rocking lever (15) are installed such, as is the case with the first rocking lever (7), that the linking points (12, 13) are performing a motion going up and down in opposition. With a similar arrangement of the three linking points (12, 13, 16) on both rocking levers (7, 15) both sides of the knife grids (5, 6) are performing a same up and down going motion. The link between the two rocking levers (7, 15) may be realized, such that the two rocking levers (7, 15) are rocking in phase, such as represented in the FIGS. 2, 8 and 9. Herewith, the third lever arm (10) is situated for both rocking levers (7, 15) on the same side of the linking surface between the axes of rotation of both rocking levers (7, 15). This has the advantage that identical rocking levers can be used. Furthermore, it is also possible to constitute the link between both rocking levers (7, 15), such that the two rocking levers (7, 15) are rocking in opposition, as represented in FIG. 7. This has the advantage that each motion of a rocking lever (7, 15) will be dynamically compensated by the motion in opposition of the other rocking lever (15, 7). The first and second rocking levers (7, 15) are linked together by means of a linking rod (14).

As represented in FIG. 3, at least one first rocking lever (7) may be linked with two single second rocking levers (17) rotating about a same axis (18) and which have at least two linking points (47, 48), in a first linking point (48), the connecting rod (14) being linked, which is constituting the link between the first rocking lever (7) and the second rocking lever (17) and in a second linking point (47) the connecting rod (11*a*) being linked, which is constituting the link between the second rocking lever (17) and the extremity of a knife grid of a set (5, 6), both extremities of the knife grids (5, 6) performing a motion in opposition. In order to link the first rocking lever (7) with the two single second rocking levers (17), the first rocking lever (7) is provided with two third lever arms (31, 32) which by means of a linking point (37), are linked with a linking rod (14), which through a linking point (48), is linked with one of the two single second rocking levers (17). The linking points (37) of the first rocking lever (7) with the linking rods (14) are situated on either side of the linking surface, being constituted by the axis of rotation of the first rocking lever (7) and the axis of rotation (18) of the two single second rocking levers (17), in order to make both second rocking levers (17) perform a motion in opposition, such that their second linking point (47) is performing a motion in opposition to the extremity of the knife grids (5).

Figure 10:
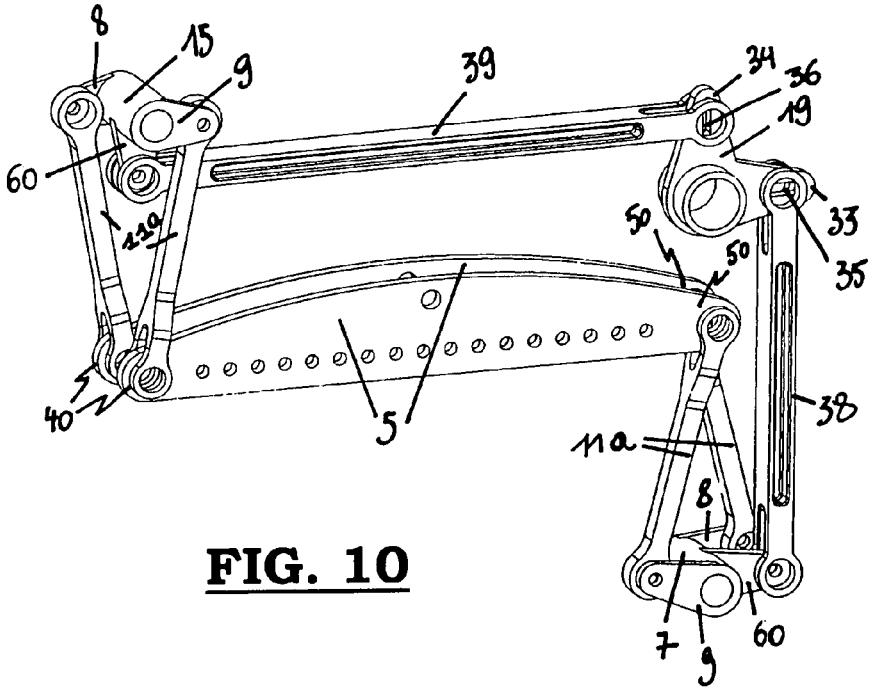
FIG. 10 is representing yet another embodiment of a drive of knife grids of a Jacquard machine according to the invention, both the first and the second rocking levers being directly driven by the first and second cam follower lever.

In yet another embodiment of a Jacquard machine according to the invention, as represented in FIG. 10, at least one of the driving levers (2, 3) (not represented in the drawing) is linked with an intermediate lever (19) with two lever arms (33, 34) each of which in a linking point (35, 36) are linked with a connecting rod (38, 39), one connecting rod (38) constituting the link between the intermediate lever (19) and a first rocking lever (7), whereas the second connecting rod (39) is constituting the link between the intermediate lever (19) and a second rocking lever (15), and both rocking levers (7, 15) being provided with at least a first lever arm (8) and a second lever arm (9), each being linked with an extremity of a knife grid (5, 6) of one side of the Jacquard machine. The connecting rods (38, 39) are linked with the rocking levers (7, 15) by means of another lever arm (60).

The mutual link between the lever arms (8, 9, 10, 60, 31-34) and/or the link between the lever arms and the extremities of the knife grids (5, 6) preferably occurs by means of linking rods (11*a*, 11*b*, 14).

Figure 8:
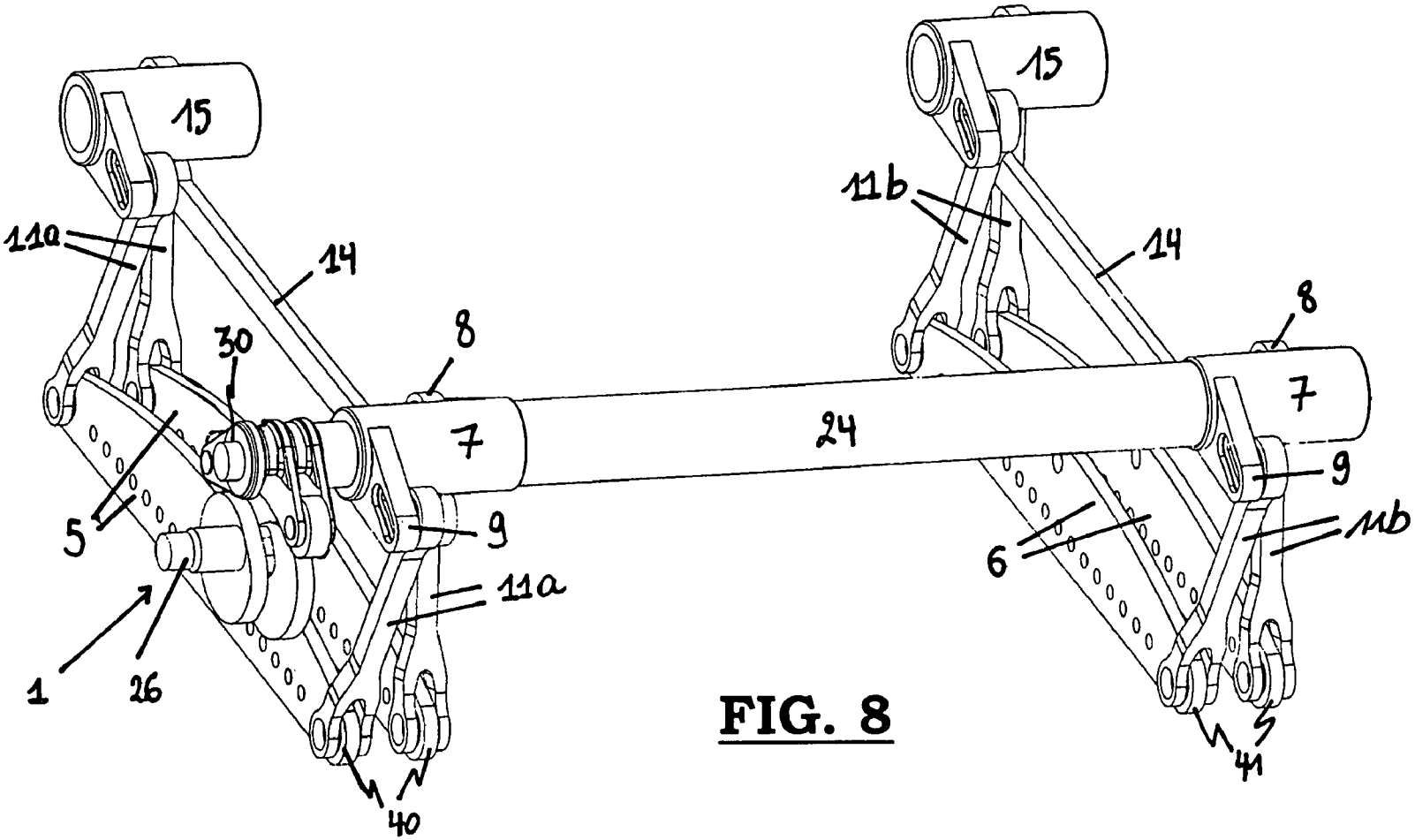

As represented in FIG. 8, on the other hand, the drive (1) may be provided with one driving lever (30), driving the traversing rocking shaft (24), on both sides of the shaft (24), a first rocking lever (7) being connected, provided with at least a first and a second lever arm (8, 9) each of which being linked with one extremity (40, 41) of one of the two knife grids (5, 6) of a set.

When the linking points (40, 41, 50, 51) in which the connecting rods (11*a*, 11*b*) are linked with the knife grids, in the front of the Jacquard machine, are situated practically in one line and also at the back of the Jacquard machine are situated in one line (at the extremity of the knife grid or at a certain distance from the extremity), this has the advantage that the load will be uniformly and symmetrically distributed with respect to the longitudinal direction for all knife grids (5, 6), provided that the selection pattern is uniformly distributed over the knife grids. By a uniform selection pattern is meant a pattern where the number of hooks being selected in order to be moved together with the knives (5, 6) is uniformly distributed over the Jacquard machine. This advantage is attained for instance when, as represented in the FIGS. (2, 7, 8, 9 and 10), the distance between the axes of rotation about which the first (7) and the second rocking levers (15) are rocking, is almost corresponding to the length of the knife grids (5, 6).

The single-sided drive (1) is provided with a continuously rotating input shaft (26), the rotational movement of the shaft being converted into a rocking motion. In order to realize this, on the one hand, the drive (1) may consist of a gearbox, as represented in the FIGS. (1, 2, 4 up to and including 9), the gearbox being provided with a cam shaft (26) with one or several sets of complementary cams and with one or several cam followers, equipped with follower rollers, each following the profile of one of the cam discs. On the other hand, the drive (1) may consist of an ordinary crank mechanism (not represented in the figures).

When the drive (1) is carried out as a gearbox with a cam shaft (26) and complementary cams, the driving levers (2, 3) are designed in the form of cam follower levers.

On the one hand, the cam shaft (26) may be provided with one set of complementary cams. The first and second cam follower levers (2, 3) each of which driving the knife grids (5, 6) on one side of the Jacquard machine and which themselves are driven by a same cam shaft (26) of the single drive (1) may be, with respect to the cam shaft (26) in the drive box, installed as follows:

The first cam follower lever (2) below the cam shaft (26) and the second cam follower lever (3) above the cam shaft (26), such that the two are situated diametrically opposite to one another, as represented in FIG. 1. The first cam follower lever (3) is linked with its corresponding first rocking lever (7) by means of a short shaft (23). The second cam follower lever (3) is linked with its corresponding first rocking lever (7) by means of a traversing rocking shaft (24). Such an embodiment has the advantage that the load on the cam shaft (26) of the drive (1) is symmetrical, and the cam shaft (26) has to be provided with only one set of complementary cams. However, the first rocking lever (7) on the short shaft (23) being situated not at the same level as the traversing rocking shaft (24) with its corresponding rocking lever (7). The knife grids (5, 6) are indeed, two by two, situated at the same level in order to maintain the knives in a horizontal position. The consequence of this arrangement is that the linking rods (11*a*) linking the rocking levers (7, 15) with the knife grids (5) on one side of the Jacquard machine are different as to length with respect to the linking rods (11*b*) linking the rocking levers (7, 15) with the knife grids (6) on the other side of the Jacquard machine.

Figure 5:
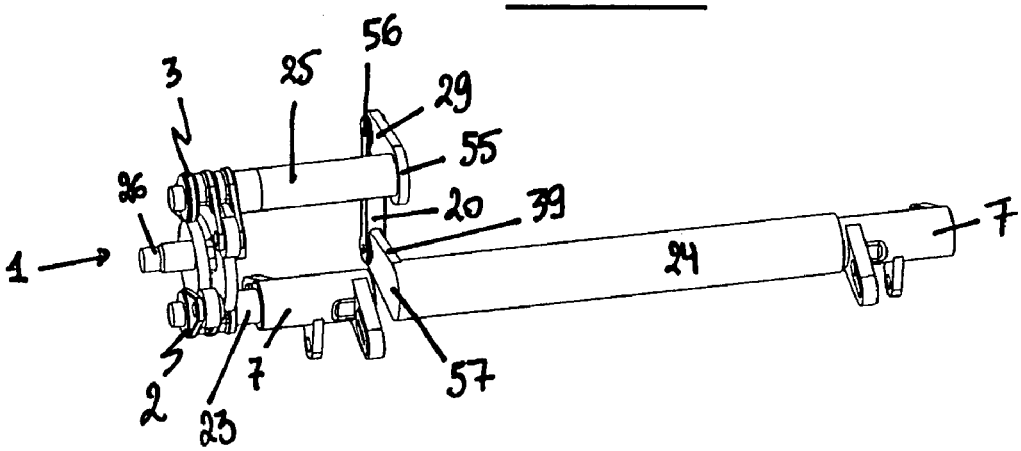
Figure 6:
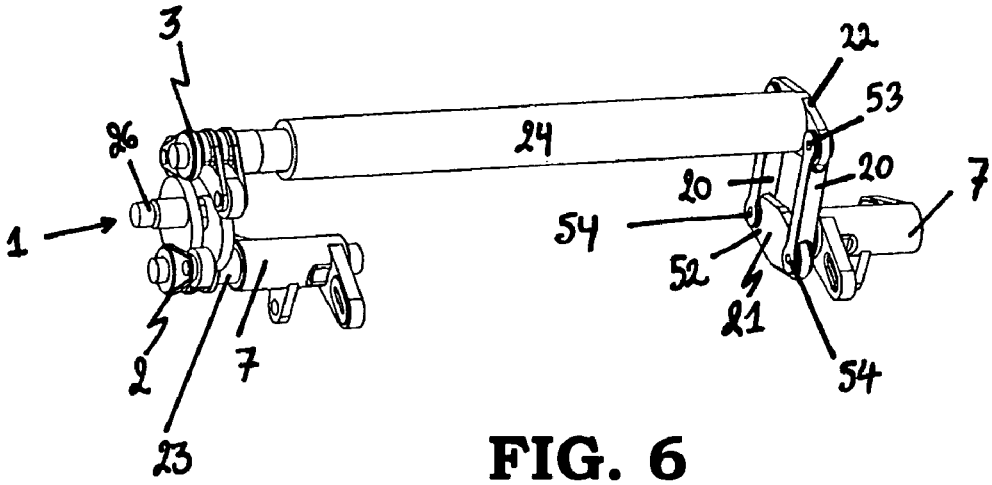
Figure 9:
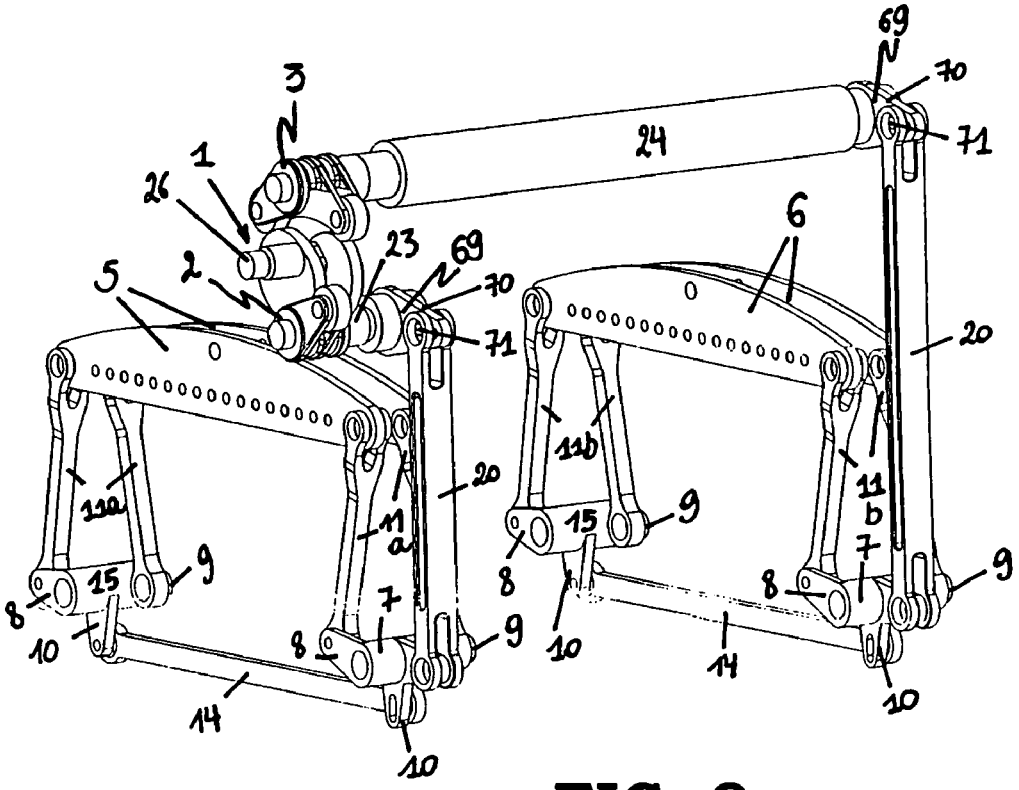

In order to avoid this problem, the Jacquard machine may be adapted, such that the two first rocking levers (7) will be rocking coaxially. Different embodiments being possible, i.e.

the first cam follower lever (2), on the corresponding short shaft (23) is provided with a lever (21) with one or two lever arms (22), each of which in a linking point (53), by means of a linking rod (20), is linked with the corresponding first rocking lever (7), which on the side of the drive (1), is coaxially mounted on bearings which on their turn are mounted on the traversing rocking shaft (24), which is linking the second cam follower lever (3) with the corresponding rocking lever (7) as represented in FIG. 4.

the second cam follower lever (3) is linked with a short shaft (25) which is provided with a lever (29) with one or two lever arms (55), each of which in a linking point (56), by means of a linking rod (20) is linked with a lever (39) with one or two lever arms (57) on a traversing rocking shaft (24), on which the first cam follower lever (2) and the corresponding rocking lever (7) are coaxially mounted on bearings. The linking rods (20) between the two times one or two times two lever arms (29, 39) are transmitting the motion of the second cam follower lever (3) to the traversing rocking shaft (24) which then will transmit the motion to the corresponding first rocking lever (7), which is situated at the extremity opposite to the drive (1) in order to drive the knife grids (6), as represented in FIG. 5;

the second cam follower lever (3) is linked with the traversing rocking shaft (24), which at its extremity, on the side away from the drive (1) is provided with a lever (21) with one or two lever arms (22), each of which in a linking point (53), by means of a linking rod (20), is linked with the lever arms (52) in linking points (54) of the first rocking lever (7) for driving the knife grids (6) on the side away from the drive (1), this first rocking lever (7) being rocking about a short shaft being coaxial with respect to the short shaft (23) linking the first cam follower lever (2) with the corresponding first rocking lever (7), as represented in FIG. 6;

the first cam follower lever (2) is linked with the short shaft (23) and the second cam follower lever (3) is linked with the traversing rocking shaft (24) (being designed as a long shaft), both cam follower levers (2, 3) on the corresponding shaft (23, 24) are linked with a lever (69) with a lever arm (70), which in a linking point (71) is linked with a connecting rod (20) constituting the link with the corresponding first rocking levers (7), these first rocking levers, each through the corresponding third lever arm (10), being linked with a linking rod (14) constituting the link with the corresponding one or several second rocking levers (15), as represented in FIG. 9.

the first cam follower lever (2) on the corresponding short shaft (23) is provided with a first intermediate lever (19) and the second cam follower lever (3) on the traversing rocking shaft (24) is provided with a second intermediate lever (19), the intermediate levers (19) being provided with two lever arms (33, 34), each of which in a linking point (35, 36) is linked with a connecting rod (38, 39), one connecting rod (38) constituting the link between the intermediate lever (19) and a first rocking lever (7), whereas the second connecting rod (39) is constituting the link between the intermediate lever (19) and a second rocking lever (3), both rocking levers (7, 15) being provided with a first lever arm (8) and a second lever arm (9), each of which is linked with an extremity (40,50) of a knife grid (5, 6) of one side of the Jacquard machine, in order to drive it, and the two first rocking levers (7) being coaxially installed, as represented in FIG. 10.

On the other hand, as represented in FIG. 7, the cam shaft (26) may be provided with two complementary cams (35), such that the first and the second cam follower lever (2, 3) are installed next to one another and are moving in opposition, the first cam follower lever (2) and the corresponding first rocking lever (7) rocking coaxially about the traversing rocking shaft (24) between the second cam follower lever (3) and the corresponding first rocking lever (7).

In replacement of a drive of a set of complementary cams with cam followers, it is also possible to provide a drive shaft with two eccentrics, each of the eccentrics driving a connecting rod, one connecting rod being linked with a lever arm of a short shaft (23) and imposing a rocking motion on this short shaft (23) and the other connecting rod being linked with a lever arm of a traversing rocking shaft (24) and imposing a rocking motion on it. Each of the connecting rods, driven by the eccentrics, is serving the function of the cam follower levers (2, 3) by making the shaft rock, about which this lever arm is fixed, by means of a lever arm linked with the extremity of the connecting rod.

The invention claimed is:

1. Jacquard machine, comprising on either side of the jacquard machine at least two knife grids moving up and down in opposition, wherein the Jacquard machine comprises a single-sided drive for driving at least one driving lever which is provided to drive the motion of the knife grids on either side of the Jacquard machine, and one and only one traversing single-component rocking shaft being coupled to said at least one driving lever to transmit the motion of the said at least one driving lever to the knife grids on one of the sides of the Jacquard machine.

2. Jacquard machine according to claim 1, characterized in that one driving lever is provided, driving the traversing single-component rocking shaft, a first rocking lever being attached on either side of the shaft, which is provided with at least a first and a second lever arm, each being linked with one extremity of one of the two knife grids of a set.

3. Jacquard machine according to claim 1, characterized in that the drive is provided to drive two driving levers, i.e.

a first driving lever, the motion of which is transmitted to the traversing single-component rocking shaft being provided with a first rocking lever at the side opposite to the single-sided drive, for driving the motion of only the knife grids on the side opposite the single-sided drive;

a second driving lever, the motion of which is transmitted to a short rocking shaft being provided with a first rocking lever at the side of the single sided drive, for driving the motion of only the knife grids on the side of the single-sided drive.

4. Jacquard machine according to claim 3, characterized in that each driving lever is provided with a first rocking lever, comprising at least a first and a second lever arm, each of which is provided to be linked with one extremity of one of the two knife grids of a set on the respective side of the Jacquard machine.

5. Jacquard machine, comprising on either side of the jacquard machine at least two knife grids moving up and down in opposition, wherein the Jacquard machine comprises a single-sided drive for driving at least one driving lever which is provided to drive the motion of the knife grids on either side of the Jacquard machine, and one traversing rocking shaft being provided to transmit the motion of the said driving lever to the knife grids on one of the sides of the Jacquard machine, characterized in that each driving lever is linked with at least one second rocking lever and the first rocking lever is provided with at least one third lever arm which is linked with a third lever arm of the second rocking lever, and a first and a second lever arm of the said second rocking levers each being linked with the other extremity of one of the two knife grids.

6. Jacquard machine according to claim 4, characterized in that the said first and second lever arms are installed such that the linking point on the first lever arm is performing a motion in opposition to the motion being performed by the linking point on the second lever arm.

7. Jacquard machine according to claim 5, characterized in that the third lever arm for both rocking levers is situated on the same side of the linking surface between the axes of rotation of these rocking levers.

8. Jacquard machine according to claim 5, characterized in that the third lever arm for both rocking levers is situated on a different side of the linking surface between the axes of rotation of these rocking levers.

9. Jacquard machine according to claim 2, characterized in that at least one first rocking lever is linked with two single second rocking levers rotating about a same shaft and each of which has at least two linking points, in a first linking point a link being constituted with the first rocking lever and in a second linking point a link being constituted with the extremity of a knife grid.

10. Jacquard machine according to claim 9, characterized in that the first rocking lever is provided with at least two third levers, whereby the linking points, which are linking the connecting rods constituting the link between the two single second rocking levers and the first rocking lever with the third lever arms of the first rocking lever, are situated on both sides of the linking surface, constituted by the axis of rotation of the first rocking lever and the axis of rotation of the two single second rocking levers, in order to make both second rocking levers perform a motion in opposition, such that their second linking point with the extremity of the knife grids is performing an opposite motion.

11. Jacquard machine according to claim 3, characterized in that at least one of the driving levers is linked with an intermediate lever with two lever arms, each of which in a linking point is linked with a connecting rod, one connection rod is constituting the link between the intermediate lever and a first rocking lever, whereas the second connecting rod is constituting the link between the intermediate lever and a second rocking lever, and both rocking levers being provided with a first lever arm and a second lever arm, each being linked with an extremity of a knife grid on one side of the Jacquard machine in order to drive it.

12. Jacquard machine according to claim 4, characterized in that the mutual link between the lever arms and/or the linking between the lever arms and the extremities of the knife grids occurs by means of linking rods.

13. Jacquard machine according to claim 1, characterized in that the drive is provided with a continuously rotating input shaft, the rotational motion of this shaft being converted into a rocking motion.

14. Jacquard machine according to claim 3, characterized in that the drive is a gearbox with a cam shaft and complementary cams, the driving levers being designed in the form of cam follower levers.

15. Jacquard machine according to claim 14, characterized in that the cam shaft is provided with one set of complementary cams.

16. Jacquard machine according to claim 14, characterized in that the first cam follower lever is provided below the cam shaft and the second cam follower lever is provided above the cam shaft, such that the two are situated diametrically with respect to one another.

17. Jacquard machine according to claim 16, characterized in that the first cam follower lever is linked with the corresponding first rocking lever by means of a short shaft.

18. Jacquard machine according to claim 14, characterized in that the second cam follower lever is linked with the corresponding first rocking lever by means of the traversing single-component rocking shaft.

19. Jacquard machine according to claim 17, characterized in that the two first rocking levers are rocking coaxially.

20. Jacquard machine according to claim 19, characterized in that the first cam follower lever on the corresponding short shaft is provided with a lever with one or two lever arms each of which in a linking point, by means of a linking rod, is linked with the lever arms of the corresponding first rocking lever, which on its drive side is coaxially mounted on bearings which are mounted on their turn on the traversing single-component rocking shaft, which is linking the second cam following lever with its corresponding first rocking lever.

21. Jacquard machine according to claim 19, characterized in that the second cam follower lever is linked with a short shaft which is provided with a lever with one or two lever arms each of which in a linking point, by means of a linking rod, is linked with a lever with one or two lever arms on the traversing single-component rocking shaft, which is situated coaxially with the short shaft linking the first cam follower lever with the corresponding first rocking lever.

22. Jacquard machine according to claim 19, characterized in that the second cam follower lever, is linked with the traversing single-component rocking shaft, which at its extremity on the side away from the drive is provided with a lever with one or two lever arms each of which in a linking point, by means of a linking rod, is linked with a lever arm of the first rocking lever for driving the knife grids on the side away from the drive, the said first rocking lever being rocking about a short shaft coaxially situated with respect to the short shaft linking the first cam follower lever with the corresponding first rocking lever.

23. Jacquard machine according to claim 19, characterized in that the first cam follower lever is linked with a short shaft and the second cam follower lever is linked with the traversing single-component rocking shaft, both cam follower levers on the corresponding shaft being linked with a lever with a lever arm which in a linking point is linked with a connecting rod constituting the link with the corresponding first rocking lever, these first rocking levers, through their respective third lever arm, each being linked with a linking rod, constituting the link with the respective one or several second rocking levers, the two first rocking levers being coaxial.

24. Jacquard machine according to claim 19, characterized in that the first cam follower lever on the corresponding short shaft is provided with a first intermediate lever, and the second cam follower lever on the traversing single-component rocking shaft is provided with a second intermediate lever, the intermediate levers being provided with two lever arms, each of which in a linking point are linked with a connecting rod, one connecting rod constituting the link between the intermediate lever and a first rocking lever, whereas the second connecting rod is constituting the link between the intermediate lever and a second rocking lever, both rocking levers being provided with a first lever arm and a second lever arm, each of which is linked with an extremity of a knife grid of one side of the Jacquard machine in order to drive it, and the two first rocking levers being coaxial.

25. Jacquard machine according to claim 14, characterized in that the cam shaft is provided with two sets of complementary cams, such that the first and the second cam follower levers are next to one another and are moving in opposition, the first cam follower lever and the respective first rocking lever coaxially rocking about the traversing single-component rocking shaft between the second cam follower lever and its respective first rocking lever.

26. Jacquard machine according to claim 1, characterized in that the drive is a crank mechanism or an eccentrically driven connecting rod.

27. Jacquard machine according to claim 26, characterized in that the drive comprises a drive shaft with two eccentrics, each eccentric driving a connecting rod, one connecting rod imposing a rocking motion on a short shaft and the other connecting rod imposing a rocking motion on the traversing single-component rocking shaft.

* * * * *